United States Patent [19]

Reynolds et al.

[11] Patent Number: 4,601,042

[45] Date of Patent: Jul. 15, 1986

[54] ELECTRIC ARC FURNACES

[75] Inventors: Timothy Reynolds, Cumbria; Robert W. Montgomery; Harold Swaby, both of Sheffield; Henry C. Garner, Mexborough, all of England

[73] Assignee: British Steel Corporation, Great Britain

[21] Appl. No.: 596,255

[22] Filed: Apr. 3, 1984

[30] Foreign Application Priority Data

Apr. 7, 1983 [GB] United Kingdom ..... 8309469

[51] Int. Cl.[4] ..... H05B 7/101

[52] U.S. Cl. ..... 373/93; 373/90; 373/94

[58] Field of Search ..... 373/91, 92, 93, 94, 373/100, 101, 99, 90

[56] References Cited

U.S. PATENT DOCUMENTS 4,453,254 6/1984 Ehle et al. ..... 373/93

4,509,178 4/1985 Lades et al. ..... 373/93

FOREIGN PATENT DOCUMENTS 0071517 2/1983 European Pat. Off. ..... 373/93

*Primary Examiner*—Roy N. Envall, Jr.

*Attorney, Agent, or Firm*—Kinney & Lange

[57] ABSTRACT

This invention concerns apparatus for selectively connecting an electrode of an electric arc furnace to a source of cooling fluid. The apparatus includes a coupling having passageways extending therethrough for the flow of cooling fluid and comprises at least two separable sections, one such section being connected to receive cooling fluid from the source and the other to convey such cooling fluid to the electrode when coupled to the said one section. Guide means are provided to guide one separable section into close proximity to the other section and to clamp the assembled sections together to connect the electrode to the source of cooling fluid.

15 Claims, 5 Drawing Figures

ELECTRIC ARC FURNACES

This invention relates to apparatus for and methods for supplying services to a removable electrode of an electric arc melting or smelting furnace; such services typically include any form of electrical signal or supply, liquid media or gaseous media. Such an electrode may be a composite electrode which contains a non-consumable water cooled section, of an electric arc melting or smelting furnace.

Hitherto, removable furnace electrodes have conventionally been fully consumable and have required only the connection of an electrical power for melting which was introduced to the electrode via the electrode clamp; the introduction of composite electrodes having a non-consumable water cooled upper section onto which is attached a consumable working electrode tip has led to the requirement for a number of additional services to be connected to the removable electrode including liquid cooling media, gaseous media and electrical signals.

Previously the connection of additional services to the removable composite water cooled electrode has had to be made manually and has proved to be mechanically cumbersome and time consuming as well as being potentially dangerous to the plant operator. The present invention sets out to overcome these difficulties.

According to the present invention there is provided apparatus for selectively connecting an electrode of an electric arc furnace to a source of cooling fluid, the apparatus including a coupling having passageways extending therethrough for the flow of cooling fluid and comprising at least two separable sections, one such section being connected to receive cooling fluid from the source and the other to convey such cooling fluid to the electrode when coupled to the said one section, means operable to guide one separable section into close proximity to the other section, and means operable to clamp the assembled sections together to connect the electrode to the source of cooling fluid.

One coupling section may be carried by the electrode and the other section by an electrode support arm of the furnace. In one arrangement said other section is permanently mounted within a frame located to one side of the electrode and movable vertically within a guide structure carried by the electrode arm, said one coupling section being movable vertically by the electrode towards the frame and into engagement with said other section to place the electrode in communication with the source of cooling fluid.

The said other coupling section may be movable horizontally towards and away from the said one coupling section by a piston/cylinder device.

In an alternative arrangement, the coupling section is located about the circumference of the electrode, said one coupling section being secured to the electrode and said other section being initially mounted on the electrode arm, and once clamped to said one section, being movable vertically therewith.

The said other coupling section may be split vertically into at least two sections, each section being insulated electrically from one another.

The coupling may include additional passageways for conveying electrical signals to and from the electrode.

The invention will now be described by way of example only with reference to the accompanying drawings in which.

Figure 1:
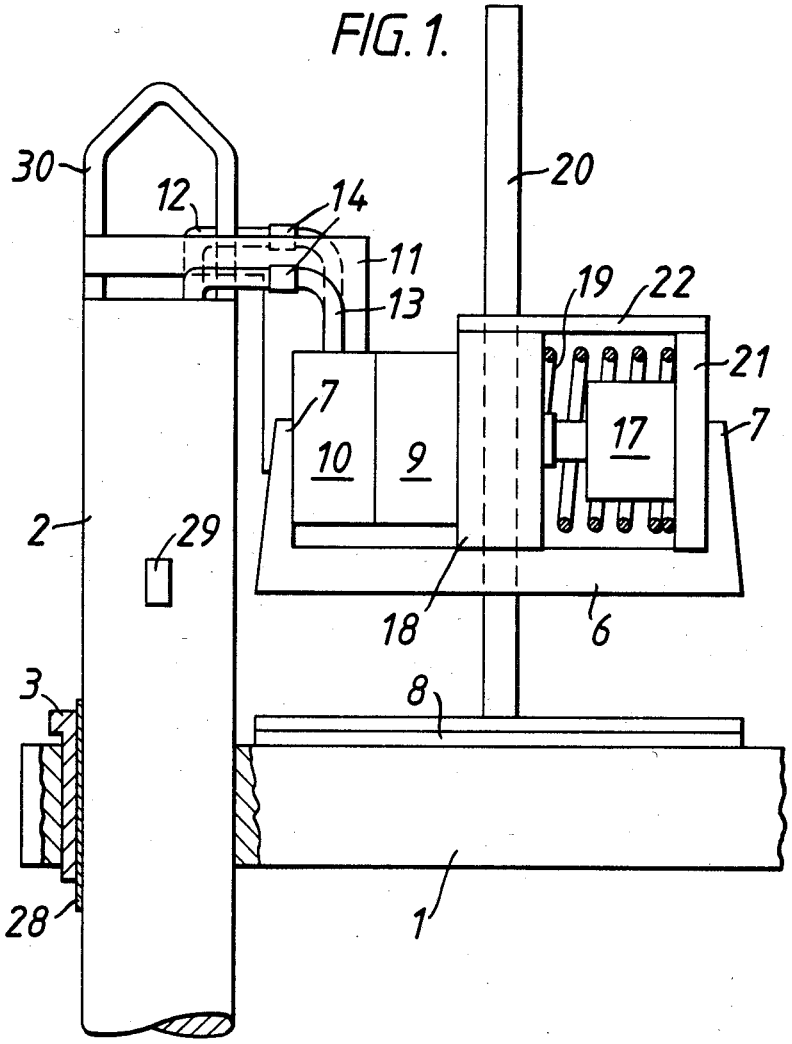
FIG. 1 is an elevational view partly in section of apparatus in accordance with the invention

The apparatus illustrated in FIGS. 1 to 4 of the drawings includes an electrode support arm 1 of an electric arc furnace which supports a water cooled electrode 2.

The electrode 2 is removable from its seating on the arm 1, and once assembled, is clamped to the arm by a pressure pad 3. Electrical power to the electrode is passed along the arm 1 through copper tubing from a mains source and enters the electrode 2 through copper bus-bar blades 4 and copper contact pads 5 carried by the arm 1. Conventionally, the arm 1 is raised and lowered through motors to regulate the height of the electrode within the arc furnace.

All services (e.g. cooling water, gas and electrics) are supplied to the furnace through a coupling housed within a frame 6 comprising a pair of chamfered clamps 7. The frame 6 is initially supported on the electrode arm and is insulated therefrom by a pad of insulation material 8.

The coupling is formed in two separable sections 9, 10 and is preferably constructed of a non-magnetic material to prevent the induction of eddy currents by electrical currents passing through the coupling sections.

The section 9 is permanently located within the frame 6 and is connected to receive cooling water and gas from mains sources along with electrical signals from the electrode 1. Conventionally, the electrical signal connections are for measurement and instrumentation purposes.

The section 10 is attached to the water cooled electrode 2 through a bracket 11 and is connected to the services through the coupling section 9. Pipes 12, 13 connected to the coupling section 10 are provided for conveying cooling water respectively to and from cooling channels provided in the electrode 2.

Rubber jointing hoses 14 are located on each pipe for ease of assembly, to electrically insulate the coupling from heavy electrical currents conducted by parts of the electrode 2 and to accommodate thermal expansion.

Cooling water is conveyed to and from the coupling section 9 through ports 15, 16 communicating with hoses (not shown) connected to a water source and sink respectively.

A pneumatic cylinder 17 is positioned within the frame 6 and is connected to the coupling section 9 which slides within the guide structure 18 integral with frame 6 to move section 9 towards and away from the coupling section 10. A coil spring 19 encompasses the cylinder 17 and is operable to urge the coupling section 9 towards and into contact with the section 10.

Guides 20 are upstanding from the arm 1 to ensure correct alignment of the coupling during movement of the electrode. The assembly of the coupling section 9, guide structure 18, cylinder 17 and spring 19 is located within a housing closed on one side by a plate 21 and covered by a plate 22 within frame 6.

Figure 3:
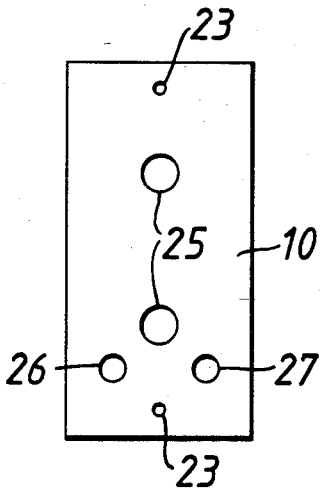
FIGS. 3 and 4 are plan views of complementary manifold blocks illustrated in FIGS. 1 and 2.
Figure 4:
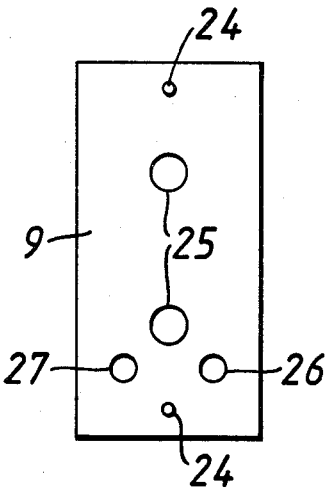

The complementary faces of the two coupling sections 9, 10 are respectively illustrated typically in FIGS. 3 and 4. A number of locating holes 23 and corresponding pins 24 are shown together with matching ports 25 for conveying cooling water to and from th electrode 2 via the pipes 12, 13 and matching holes 26, into which are fitted insulated electrical contacts for the connection of electrical signals and ports 27 for connecting gas services to the electrode.

Additional passageways may be provided for conveying fluid services to the electrode for duties other than cooling.

Secured to one face of the electrode 2 is an insulated plate 28. This plate extends downwardly over the side of the electrode which on assembly lies adjacent to the pressure pad 3 and insulates the pad from the electrode. Fins of the insulated plate protrude from the outer wall of the insulated plate 28 to assist alignment of the electrode on assmebly. Anti-turn lugs 29 protrude outwardly from the sides of the electrode 2 to assist seating of the electrode 2 on the electrode arm 1 and act to limit the downward movement of the electrode 1 in the event of clamp failure.

During assembly of the electrode into the furnace, the frame 6 is seated upon the layer of insulating material 8 and is supported by the electrode arm. Further, the pressure pad 3 is in its open position and the pneumatic cylinder 17 is retracted against the spring 19 so pulling the coupling section 9 to its open position. The electrode 2 is suspended from a crane hook through a hairpin shackle 30 above the electrode arm 1 with the lower end of the electrode positioned above the furnace opening. As the electrode 2 approaches its seating in the electrode clamp comprising the pressure pad 3 and the two copper contact pads 4, the coupling section 10 carried by the support bracket 11 takes up a position immediately above the frame 6 which, as mentioned above, is supported by the arm 1. To ensure correct location for automatic coupling, the electrode is orientated so that the pressure pad insulation plate 28 lies adjacent the pad 3.

Similarly, the bus-bar blades 5 of the electrode lie adjacent to the copper contact pads 4 attached to the electrode arm 1.

The electrode 2 is guided by fins located on the insulated plate 28 as it is lowered towards the two vertical legs of the clamp 7 of the frame 6. The support bracket 11 engages the two vertical legs of the clamp 7 on the electrode side of the assembly and with the assistance of the ingoing side chamfers of the frame, the coupling section 10 is inserted into the frame.

The electrode is lowered until the anti-turn lugs 29 rest on top of the furnace electrode arm 1. In this position the two coupling sections 9 and 10 are opposite one another.

The pneumatic cylinder 17 is then operated and the protruding locating pins 24 on the coupling section 9 engage with the matching holes 23 in the section 10 to align the respective service ports for electrics, gas and water.

The pneumatic cylinder 17 in its closed position is assisted by the spring 19, which ensures that in the event of an air failure, the coupling sections 9, 10 will not separate. Once the automatic coupling is engaged, the whole electrode assembly can be raised to the appropriate operating height within the electrode clamp assembly, the automatic coupling assembly being guided on the two rods 20 which are joined at the top with a tie plate (not shown).

The pressure pad 3 is now closed so that it firmly grips the electrode 2 against copper contact pads 4. Once the crane lifting hook has been removed, the electrode is ready for operational duties.

Figure 2:
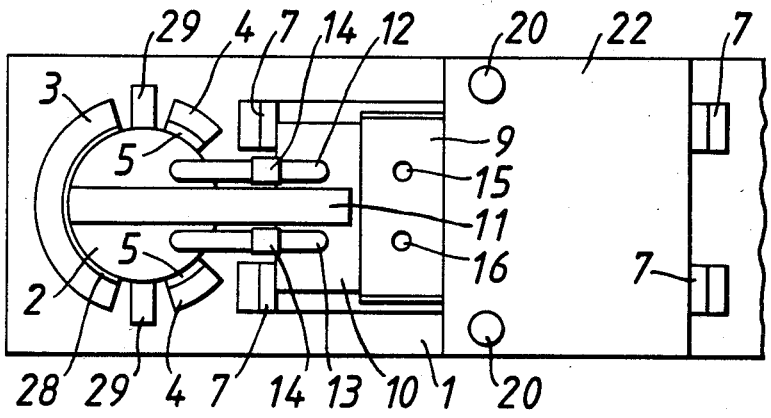
FIG. 2 is a plan view of the apparatus illustrated in FIG. 1

As illustrated in FIGS. 1 and 2, the coupling section 10 is mounted to one side of the electrode assembly. In an unillustrated alternative arrangement, the section 10 may be formed as an annulus located about the periphery of the electrode. The annulus is preferably split vertically to form two semi-circular sections separated by electrical insulation material. In this arrangement, the electrode is movable within and relative to the annular coupling section and is provided with a stop on the electrode which engages the coupling at required height to lift the same in concert with the electrode.

Figure 5:
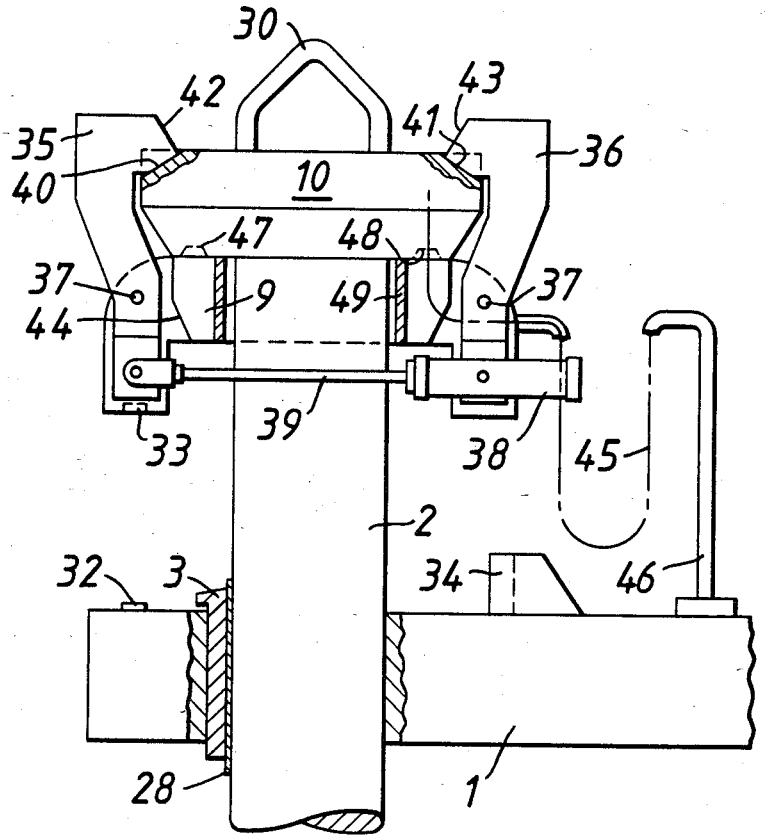
FIG. 5 is an elevational view of alternative apparatus in accordance with the invention.

In the embodiment illustrated in FIG. 5, the coupling section 10 encircles and is secured to the upper end of the electrode 2. The section 9 is also of annular construction but is split vertically to form two halves, the two half sections being electrically insulated from one another; alternatively, the section may be extensively water cooled to prevent overheating caused by the flow of eddy currents within the annular section. Coupling section 9 is initially supported on the electrode arm 1 and is positively located by means of spigots 32 upstanding from the arm 1 which protrude into recesses 33 formed in the under-surface of section 9 and/or by lugs 34 mounted on the arm. As illustrated in FIG. 5, the section 9 is coupled to the section 10 by means of a pair of pivotable arms 35, 36. The arms 35, 36 are each mounted for pivotal movement on pins 37 supported between downwardly extending legs of the coupling section 9. Movement of the arms is controlled by hydraulic or pneumatic cylinders 38 (only one of which is illustrated) which are carried by one arm 36 and are connected to the other arm 35 by extended cylinder rods 39.

The engaging faces 40, 41 of the arms 35, 36 and of the coupling section 10 are inclined in a complementary manner to ensure correct alignment of the section 10 with respect to section 9. In addition, the inwardly facing upper entry faces 42, 43 of the arms 35, 36 are outwardly inclined to facilitate ease of assembly of the coupling section 10 onto section 9.

Coupling section 9 is formed with an inwardly inclined face 44 which acts to limit excessive pivotal movement of one arm with respect to the other and to ensure correct opening of both arms. Flexible pipes 45 communicate with ports formed in coupling section 9 to convey cooling fluid and other services to the electrode 2 via the coupling sections 9, 10. The pipes 45 are connected to a post 46 mounted on the electrode arm 1. The ports 25–27 for passing services between the coupling sections 9, 10 are formed in the mating faces 47, 48 of the sections. As will be seen in FIG. 5, the faces are set in complementary shaped protrusions and indentations to ensure correct alignment of the ports.

An electrical insulating ring 49 is positioned between the adjacent faces of the section 9 and the electrode 2.

Automatic non-return valves (not shown) are provided at the mating faces 47, 48 of the coupling sections 9, 10 to open and close off the communicating ports upon coupling and uncoupling of the sections 9, 10.

In operation of the apparatus illustrated in FIG. 5, the coupling section 9 is initially supported on the electrode arm 1 with the spigots 32 within the recesses 33 and/or the lugs 34 engaging the outer peripheries of the downwardly extending legs of the section.

As the electrode 2 is lowered with respect to the electrode arm 1, the arms 35, 36 are opened through operation of the cylinders 38 to enable the section 10 to seat on the section 9.

Movement of the arms 35, 36 is assisted by engagement of the section 10 with the inclined faces 42, 43. The inclined face 44 of the section 9 is such as to act as a stop to excessive pivotal movement of one arm 35 or 36.

The cylinder 38 in its closed position is assisted by a spring (not shown), which ensures that in the event of fluid failure, the coupling sections 9 and 10 will not separate.

On assembly of the section 10 upon section 9, the non-return valves at the adjacent ports of the two sections are automatically opened to permit the flow of services therethrough.

It is to be understood that modifications can readily be made to the apparatus illustrated in FIG. 5 without departing from the true scope of the invention. Thus, the coupling section 9 may be secured to the electrode arm 1 with the coupling section 10 mounted such that the electrode 2 can travel through the central openings of the sections in the same way as the electrode 2 of FIG. 5 travels with respect to coupling section 9 of that Figure. In the unillustrated embodiment flexible hoses are provided between outlet ports of section 10 and ports set in the electrode or electrode carrier.

In a further alternative unillustrated embodiment, both coupling sections may be movable relative to the electrode nd to the electrode arm. Alternatively, the sections 9, 10 of FIG. 5 may be positioned to one side of the electrode in a manner similar to that illustrated in FIGS. 1 and 2.

We claim:

1. Apparatus for selectively connecting an electrode of an electric arc furnace to a source and receiver of cooling fluid, the apparatus including a coupling having passageways extending therethrough for the flow of cooling fluid and comprising at least two separable sections, one such section being connected to receive cooling fluid from the source and the other to convey such cooling fluid to the electrode when coupled to the said one section, means operable to guide one separable section into close proximity to the other section, and means operable to clamp the assembled sections together to connect the electrode to the source of cooling fluid.

2. Apparatus as claimed in claim 1 wherein one coupling section is carried by the electrode and the other section by an electrode support arm of the furnace.

3. Apparatus as claimed in claim 2 wherein said other section is permanently mounted within a frame located to one side of the electrode and movable vertically within a guide structure carried by the electrode arm, said one coupling section being movable vertically by the electrode towards the frame and into engagement with said other section to place the electrode in communication with the source of cooling fluid.

4. Apparatus as claimed in claim 3 wherein said other coupling section is movable horizontally towards and away from the said one coupling section by a piston/-cylinder device.

5. Apparatus as claimed in claim 2 wherein the coupling section is located about the circumference of the electrode, said one coupling section being secured to the electrode and said other section being initially mounted on the electrode arm and, once clamped to said one section, being movable vertically therewith.

6. Apparatus as claimed in claim 2 wherein the coupling is located about the circumference of the electrode, said other coupling section being secured to the electrode support arm and said one section being movable vertically into and out of clamping engagement with said other section.

7. Apparatus as claimed in claim 5 or claim 6 wherein said other coupling section is split vertically into at least two sections, each section being insulated electrically from one another.

8. Apparatus as claimed in claim 1 wherein the coupling includes additional passageways for conveying electrical signals from the electrode.

9. Apparatus as claimed in claim 1 wherein the electrode is a composite electrode including a non-consumable water cooled upper section and a consumable tip section.

10. In an electric arc furnace, apparatus for supporting and selectively connecting coolant flow channels of an electrode to a source and receiver of cooling fluid, the electrode support apparatus comprising a movable electrode support arm formed with an opening into which the electrode can releasably be clamped at a variable height relative to the support arm, the electrode connection apparatus comprising a coupling separable from the electrode support arm and including two separable sections each formed with passages for the through-flow of cooling fluid, means for placing the passages of one coupling section in communication with a source of cooling fluid, means for placing the passages of the other coupling section in communication with the coolant flow channels of the electrode, means operable to guide one coupling section into close proximity to the other coupling section, and means operable to clamp the sections together with the passages of the assembled sections aligned whereby the coolant flow channels of the electrode are connected to the source and receiver of cooling fluid.

11. Apparatus as claimed in claim 10 wherein one coupling section is permanently mounted within a frame located to one side of the electrode and movable vertically within a guide structure carried by the electrode support arm, said other coupling section being movable vertically by the electrode towards the frame and into engagement with said one coupling section.

12. Apparatus as claimed in claim 11 wherein said one coupling section is movable horizontally towards and away from the said other coupling section by a piston/-cylinder device.

13. Apparatus as claimed in claim 10 wherein the coupling is located about the circumference of the electrode, said one coupling section being secured to the electrode and said other section being initially mounted on the electrode arm and, once clamped to said one section, being movable vertically therewith.

14. Apparatus as claimed in claim 13 wherein said other coupling section is split vertically into at least two sections, each section being insulated electrically from one another.

15. Apparatus as claimed in claim 10 wherein the coupling sections include additional passageways for conveying electrical signals from the electrode.

* * * * *